US007281461B2

(12) United States Patent
McCambridge et al.

(10) Patent No.: US 7,281,461 B2
(45) Date of Patent: Oct. 16, 2007

(54) HAIR TRIMMER FOR USE IN SELF-CUTTING OR ON OTHERS

(75) Inventors: James E. McCambridge, Polo, IL (US); Scott A. Melton, Erie, IL (US); Raymond A. Nielsen, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

(21) Appl. No.: 11/378,880

(22) Filed: Mar. 17, 2006

(65) Prior Publication Data

US 2006/0156880 A1 Jul. 20, 2006

Related U.S. Application Data

(62) Division of application No. 10/705,537, filed on Nov. 10, 2003, now abandoned.

(51) Int. Cl.
*B26B 19/14* (2006.01)

(52) U.S. Cl. ..... 83/13; 30/528

(58) Field of Classification Search ..... 30/527–533
See application file for complete search history.

(56) References Cited

U.S. PATENT DOCUMENTS

| | | | | |
|---|---|---|---|---|
| 1,536,662 | A * | 5/1925 | Cowan | 30/31 |
| 1,598,737 | A | 9/1926 | Marcotte | |
| 1,644,141 | A | 10/1927 | Mcardle | |
| 1,646,470 | A | 10/1927 | Wright | |
| 2,118,850 | A | 5/1938 | Rene | |
| 2,279,102 | A | 4/1942 | Dobson | |
| 3,797,109 | A * | 3/1974 | Yamada et al. | 30/43.1 |
| 4,118,863 | A | 10/1978 | Sandy | |
| 4,138,809 | A * | 2/1979 | Pires | 30/200 |
| 4,709,475 | A * | 12/1987 | Phung | 30/31 |
| 4,782,592 | A | 11/1988 | Altamore et al. | |
| 5,165,172 | A | 11/1992 | Weinrauch | |
| 5,933,964 | A | 8/1999 | Altamore et al. | |
| 6,125,542 | A * | 10/2000 | Somma | 30/46 |

FOREIGN PATENT DOCUMENTS

| | | |
|---|---|---|
| EP | 0 707 926 A1 | 4/1996 |
| FR | 578755 | 7/1925 |
| GB | 2 383 970 A | 7/2003 |
| JP | 352046969 A | 4/1977 |

* cited by examiner

*Primary Examiner*—Kenneth E. Peterson
(74) *Attorney, Agent, or Firm*—Greer, Burns & Crain, Ltd.

(57) ABSTRACT

A bladeset for a hair clipper includes blade teeth configured to guide hair strands toward a cutting zone and to retain hair strands in the cutting zone. By more effectively guiding and retaining the hair strands into the cutting zone, more complete hair cutting may be achieved. Another feature of the present self-cutting hair trimmer is a housing configured to provide a cutting line associated with a generally elongate handle, which in turn provides a bladeset angle of attack substantially perpendicular to hair to be cut on all parts of a self-user's head or a subject's head when the present trimmer is held by a user in either hand.

13 Claims, 8 Drawing Sheets

HAIR TRIMMER FOR USE IN SELF-CUTTING OR ON OTHERS

This is a divisional of application Ser. No. 10/705,537, filed Nov. 10, 2003, now abandoned and Applicants claim priority under 35 USC § 120 from the above-identified parent application.

FIELD OF THE INVENTION

This invention relates to electric hair trimmers and clippers, and more particularly, to such devices designed for use by an individual in cutting his or her own hair, and also to such devices designed for use by one person to cut the hair of another.

BACKGROUND OF THE INVENTION

Electric hair trimmers or clippers (interchangeable here) are commonly used by stylists, barbers, or individuals for styling the hair of others. However, it is known to provide an electric hair clipping device designed specifically for self-cutting. One such self-cutting electric hair trimmer (see, e.g., commonly-assigned U.S. Pat. No. 4,118,863, to Sandy, issued Oct. 10, 1978, and incorporated by reference herein) is somewhat effective for non-skilled hair trimming and thinning, e.g., between professional haircuts. An important feature of the '863 patent is the provision of a moving blade with teeth extending past the relatively shorter teeth of the fixed or stationary blade. One benefit of such an arrangement is that the longer moving blade teeth help to move and randomly cut the hair, creating a general thinning rather than cutting a uniform swath through the hair, as would a more conventional clipper. However, such a trimmer presents at least two related problems.

The '863 patent features a bladeset with moving teeth shaped to guide relatively small amounts of hair into a cutting zone formed by an overlap between the moving teeth and shorter stationary teeth. Generally, the depth of this cutting zone is on the order of two to three perpendicular diameters of a human hair. If two hairs are "stacked" in the cutting zone, with one hair in the part nearest to a root of either of the stationary and moving teeth, and one hair adjacent to it but farther from the teeth roots and protruding from the cutting zone, the protruding hair may be nicked, or may be cut only partially through. This nicked or partially cut hair may sever and fall off several days after the trim, an undesirable result, and in some cases misleading the user that hair is being lost.

Further, at least some typical conventional hair trimmers are shaped to be held in a way that is inconvenient for self-cutting. More specifically, the trimmers are shaped so that they are difficult to hold such that the angle of attack (the angle made by the plane of the cutting zone and the hair strands to be cut) of the bladeset is substantially perpendicular to the hairs to be cut, such as the hairs on the back of a self-user's head. When the angle of attack is substantially not perpendicular, the hairs enter the cutting zone at an oblique angle. This not only exacerbates the problem of "stacked" hairs in the cutting zone described above, but presents a situation in which the elongated cross-section of a single hair at an oblique angle to the cutting zone may exceed the cutting zone depth, leading to the same nicking or partial cutting described above.

In instances when the user attempts to cut the back of his head at the appropriate angle of attack, the wrist must be angled sharply or "cocked" to one side. This resulting position, known as ulnar deviation, is a biochemical deviation that may cause pain, discomfort, or even tendonitis, especially when the position is held for extended periods.

Such ergonomic considerations are also an issue when one person cuts another person's hair. At least some conventional hair trimmers are shaped to be held in a way that is inconvenient for cutting other's hair. This is especially the case for users with limited hand and/or arm mobility, such as sufferers from arthritis or injuries to the hand and/or arm.

Accordingly, there is a need for an improved self-cutting hair trimmer which reduces the amount of nicking and/or partial cutting of hair caused by conventional self-cutting hair trimmers. There is also a need to provide for the more effective guiding of hairs into or retaining of hairs in a cutting zone of a bladeset of a hair trimmer. There is still another need for a hair trimmer holdable by a self-user or hair stylist such that the bladeset angle of attack is substantially perpendicular to the hair to be cut on all areas of the head, without causing discomfort to the user when holding the trimmer for self-cutting, or by the stylist when cutting the hair of another.

SUMMARY OF THE INVENTION

The present invention addresses the needs described above with, among other things, a bladeset that includes blade teeth configured to guide hair strands toward a cutting zone and to retain hair strands in the cutting zone. By more effectively guiding and retaining the hair strands into the cutting zone, more complete hair cutting may be achieved. Another feature of the present hair trimmer is a housing configured to provide a cutting line associated with a generally elongate handle, which in turn provides a bladeset angle of attack substantially perpendicular to hair to be cut on all parts of a self-user's head when the present trimmer is held by the self-user in either hand. In another embodiment, the trimmer is provided with a handle configuration so that one person can cut the hair of another and obtain the desired angle of attack. Both embodiments feature handle shapes configured to reduce operator ergonomic stress.

More specifically, a bladeset for a hair trimmer includes a stationary blade having a plurality of stationary blade teeth and a moving blade having a plurality of moving blade teeth. The moving blade is configured for laterally reciprocating relative to the stationary blade to cut hair between its teeth and the stationary blade teeth. Teeth on the moving blade extend beyond the stationary blade teeth, forming a cutting zone where the moving blade teeth and the stationary blade teeth overlap. Further, the blade teeth are configured to guide hair strands toward the cutting zone, and to retain hair strands in the cutting zone.

DETAILED DESCRIPTION OF THE PREFERRED EMBODIMENT

Figure 1:
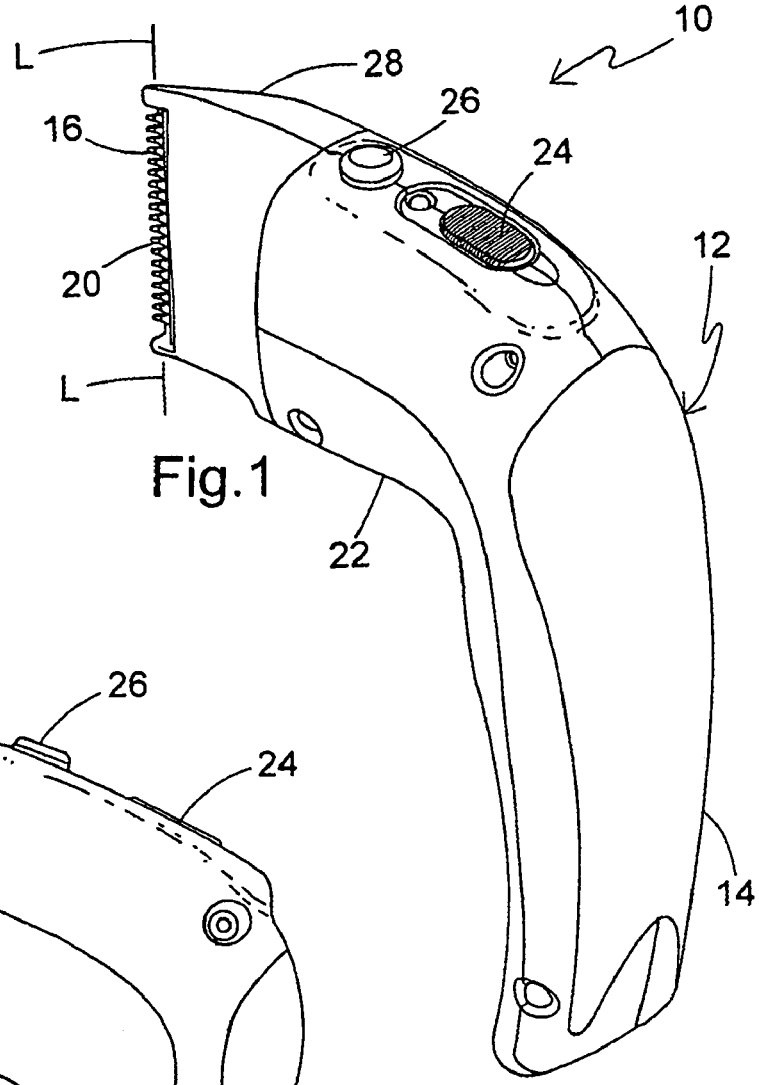
FIG. 1 is a top perspective view of the present hair trimmer.
Figure 2:
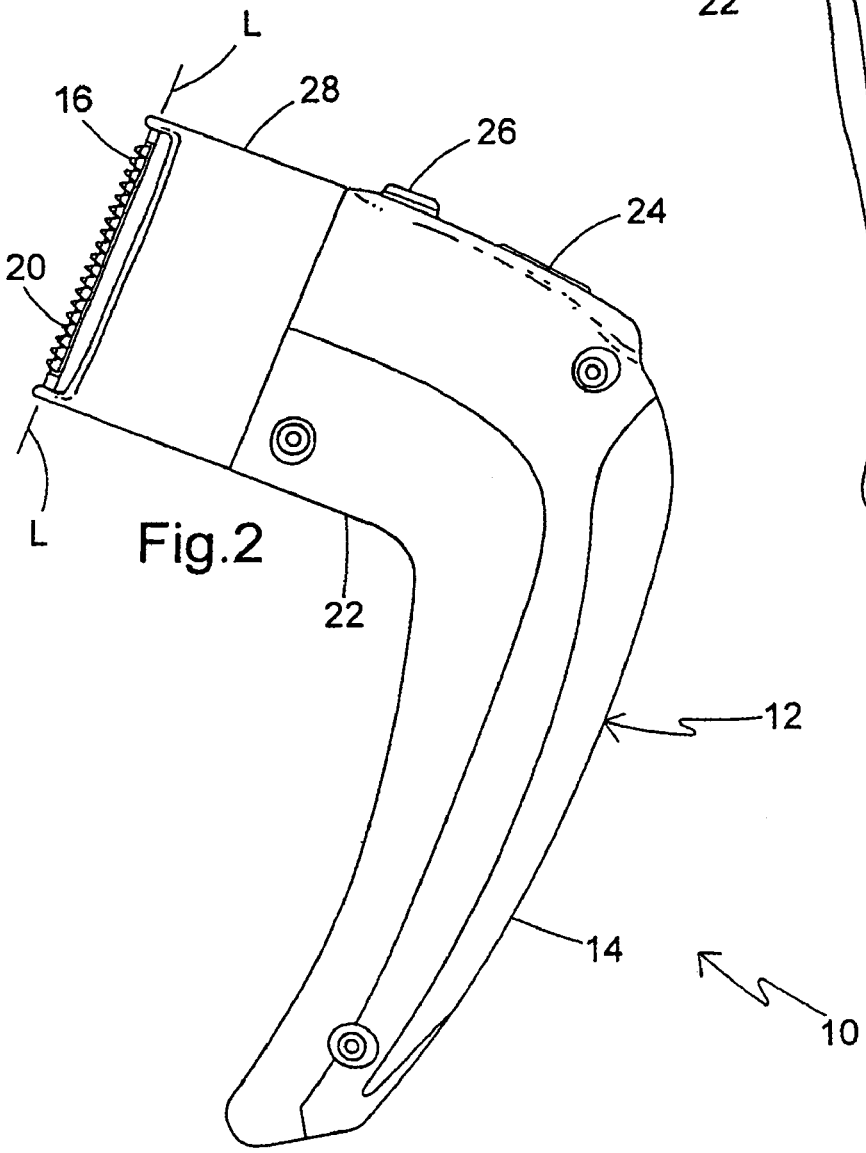
FIG. 2 is a side view of the hair trimmer of FIG. 1.
Figure 3:
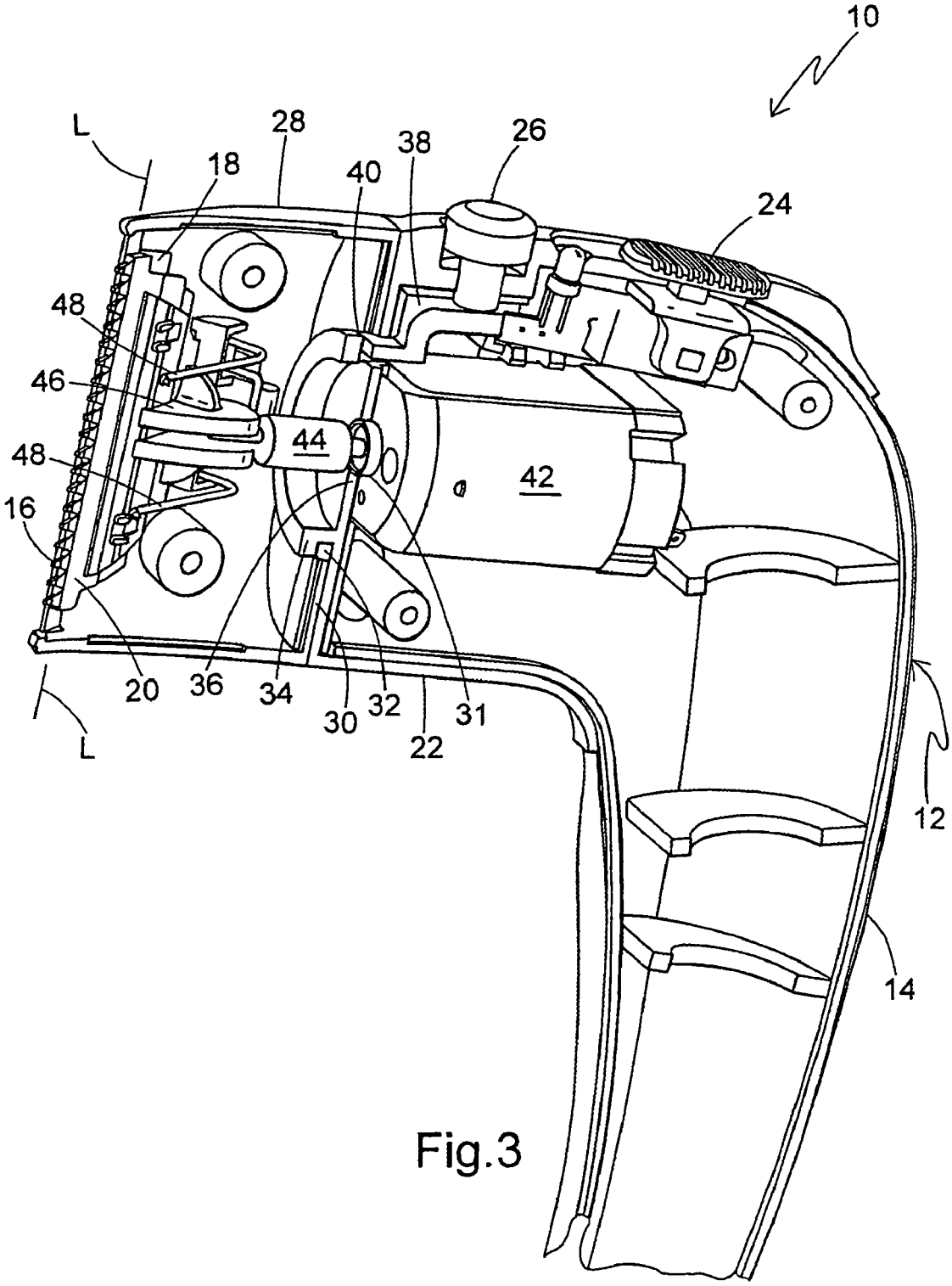
FIG. 3 is a sectional perspective view of the hair trimmer of FIG. 1.

Referring to FIGS. 1-3, a preferred embodiment of the present invention is a hair trimmer generally designated 10 that includes a housing 12 having a handle 14 and a bladeset 16. The handle 14 is generally elongate and has a longitudinal axis. Included on the bladeset 16 is a stationary blade 18 and a moving blade 20. The moving blade 20 is configured for laterally reciprocating relative to the stationary blade 18 for cutting hair between the stationary blade and the moving blade. Such lateral reciprocation defines a cutting line "L" which is generally parallel to the axis of the handle 14 (FIG. 2).

In the preferred embodiment, the bladeset 16 is displaced transversely from the axis of the handle 14 by a displacement component 22 of the housing 12. Included on the displacement component is an on/off switch 24 and a lock actuator 26. Upon pressing the lock actuator 26, rotation of a blade assembly 28 is permitted, which serves as a mount for the bladeset 16.

In the preferred embodiment, blade assembly 28, part of the housing 12, is configured to be rotatably engaged on the displacement component 22 of the housing between two positions. Preferably, the positions are 180° from each other. However, alternate angular displacements, as well as additional positions for the blade assembly 28 are contemplated, depending on the application. At either of these two preferred positions, the cutting line "L" defined by the lateral reciprocating action of the moving blade 20 relative to the stationary blade 18 is generally parallel to the axis of the handle 14.

Referring now to FIG. 3, a rear wall 30 of the blade assembly 28 defines an opening 31 which is captured and rotatably engaged by a groove 32 formed in a front wall extension 34 of a front wall 36 of the displacement component 22. At either of the two positions at which the cutting line "L" is generally parallel to the axis of the handle 14, the blade assembly 28 is retained by the engagement of a lock extension 38 of the lock actuator 26 in a detent 40 in the front wall extension 34. To be placed in either of these two positions, the blade assembly 28 carrying the bladeset 16 may be rotated through a full circle to reach one or the other of the two detents 40, which are spaced 180° apart. Spring-loading the lock actuator 26 keeps the lock actuator in an engaged position when not pressed by a user to prevent unwanted rotation.

Figure 4:
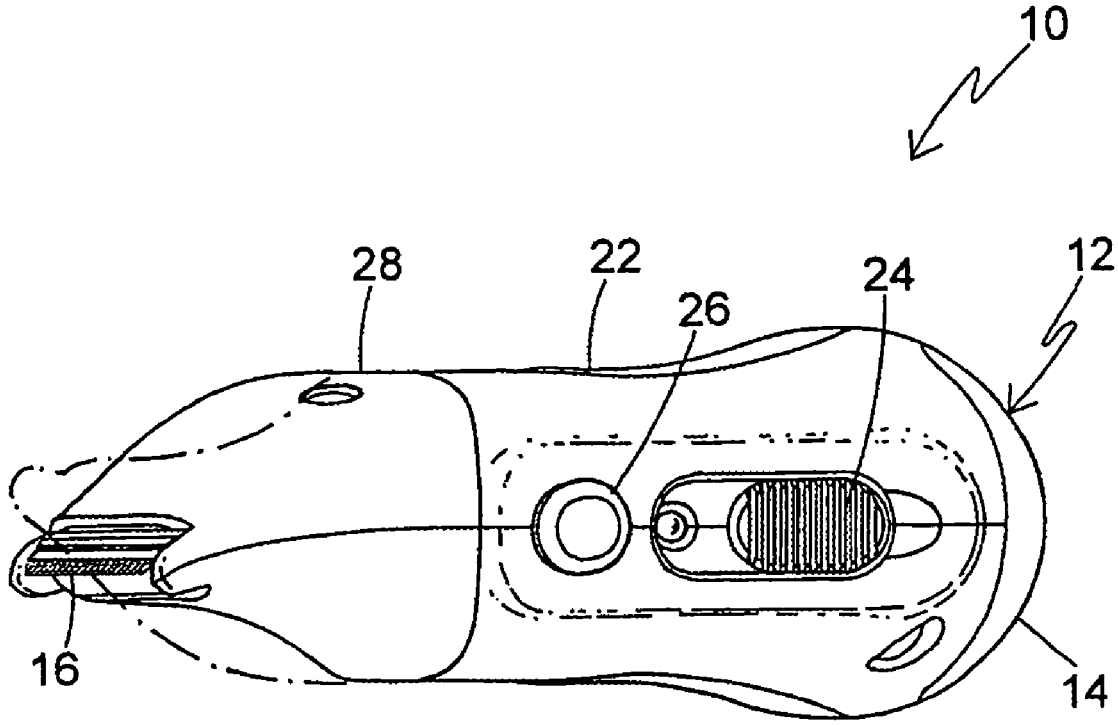
FIG. 4 is a top view of the hair trimmer of FIG. 1 as shown in a first rotated position with a second rotated position shown in phantom.
Figure 11:
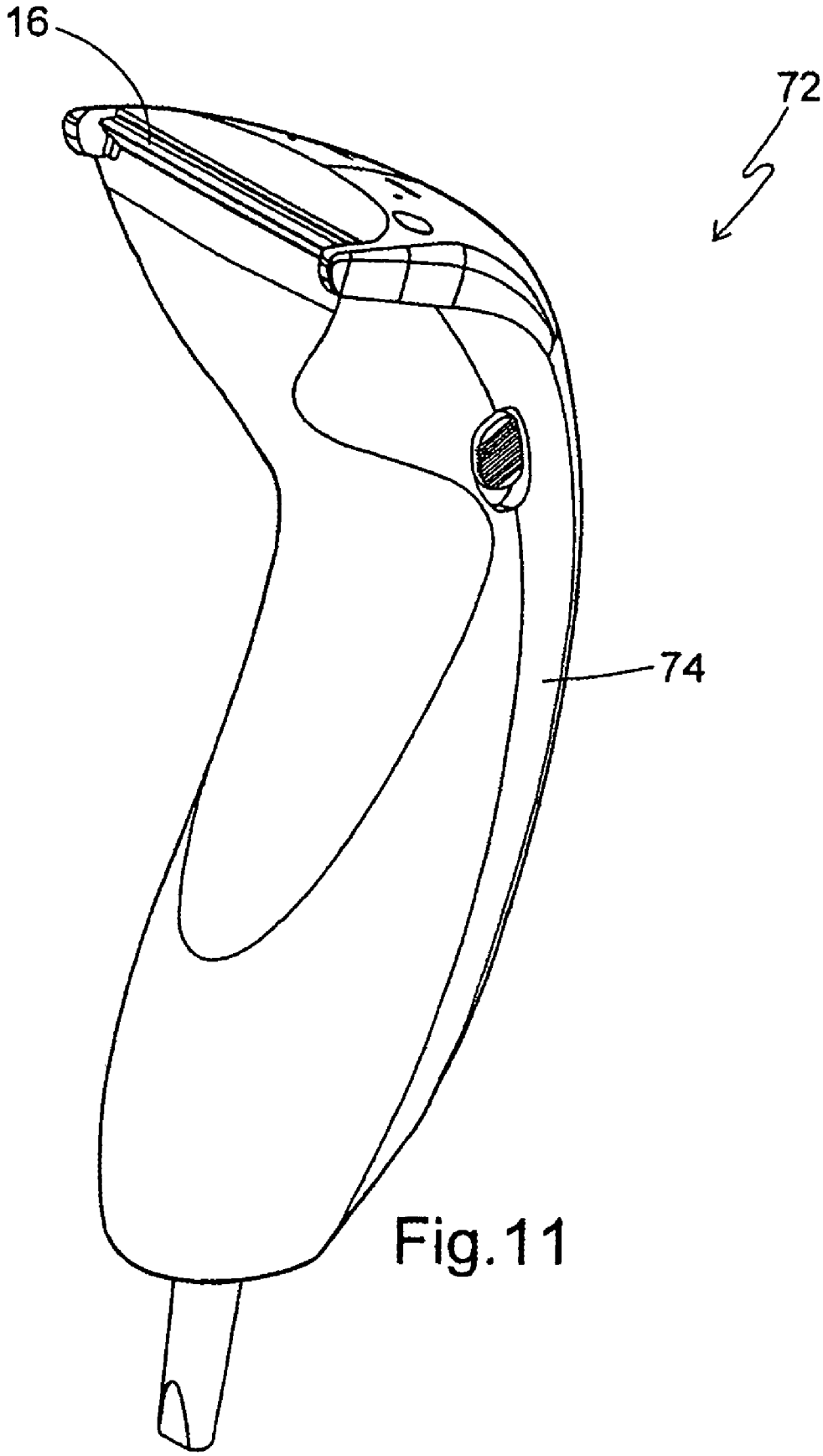
FIG. 11 is a front perspective view of an alternate embodiment of present hair trimmer.
Figure 12:
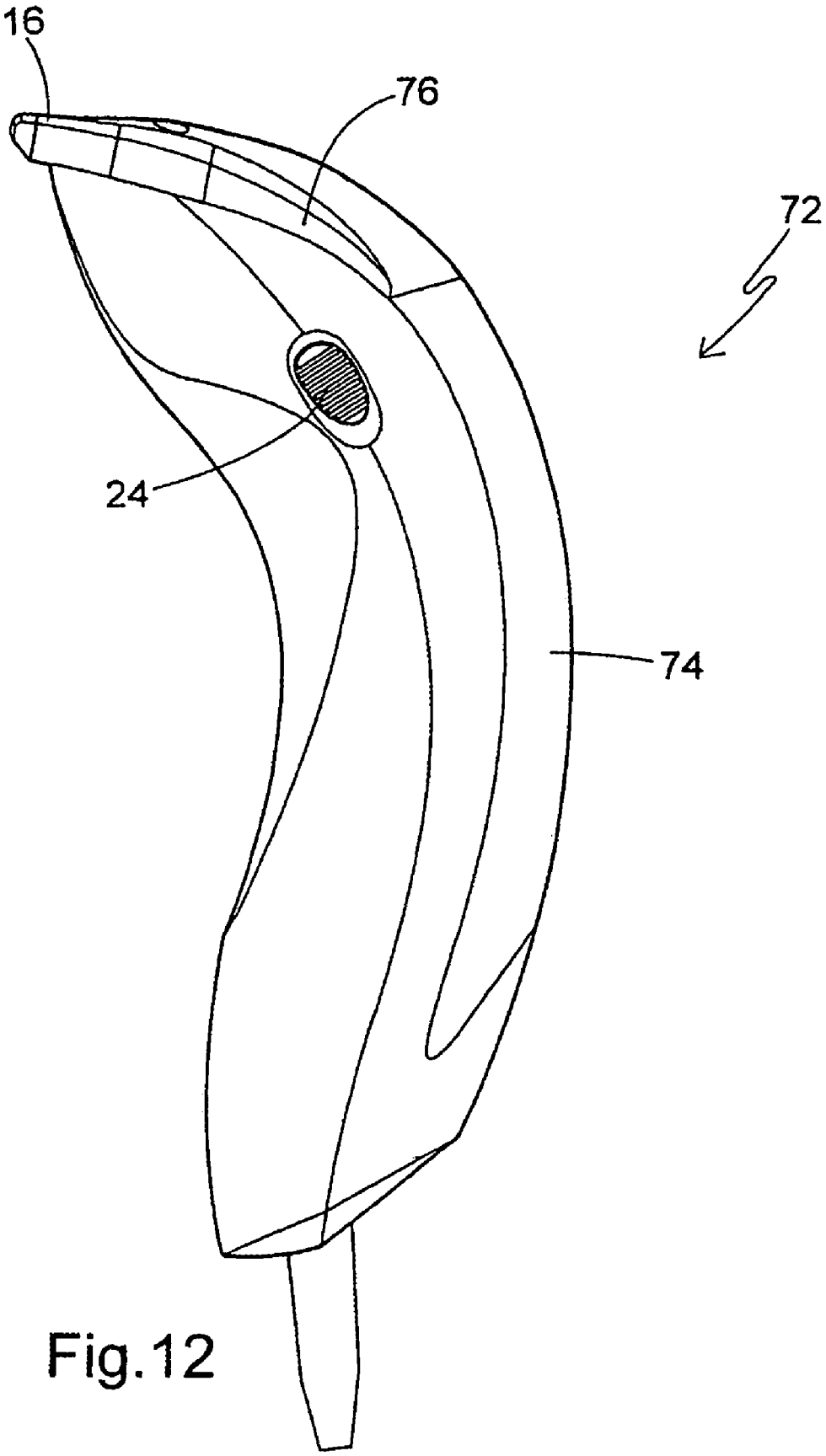
FIG. 12 is a side view of the trimmer of FIG. 11.

Referring now to FIG. 4, the blade assembly 28 is shown in one of the two preferred positions, with the other position shown in phantom. In the preferred embodiment illustrated here, the blade assembly 28 is shaped so that the bladeset 16 is offset from a vertical centerline plane of the displacement component 22. In addition, the angle of attack of the bladeset 16 is substantially perpendicular to the hair strands to be cut when a self-user holds the hair trimmer naturally with the blade assembly 28 rotated to one of the two preferred positions. It is contemplated that additional positions for the blade assembly 28 may be provided which are preferably indexed with additional detents 40, to provide flexibility for self-users, who, individually and as a group, have varying natural postures for holding the hair trimmer 10. These additional detents 40 also provide similar flexibility for the users of the trimmer 10 who are using it to cut someone else's hair. As such, a rotation of the bladeset assembly 28 to a 90° displacement from that depicted in FIG. 4 is also contemplated (FIGS. 11 and 12). Also, the bladeset 16 is rotatably disposed on the housing 12 such that the bladeset 16 rotates in a plane that is generally parallel to the axis of the handle 14.

A user of the hair trimmer 10 may hold it by the handle 14 in either a right hand or a left hand for self-cutting so that the bladeset 16 is at a particular angle of attack to the hair to be trimmed. A feature of the present invention is that this angle of attack is consistent when the bladeset 16 is in either of the two positions.

Referring again to FIG. 3, the displacement component 22 encloses an electric motor 42 for driving the lateral reciprocation of the moving blade 20. As is known in the art, the electric motor 42 rotates an eccentric cam 44 connected to the motor drive shaft or armature. A cam follower 46 that couples the eccentric cam 44 to the moving blade 20 translates the rotation of the eccentric cam 44 into the lateral reciprocation of the moving blade. Springs 48 or at least one equivalent biasing element exerts a force on the moving blade 20 against the stationary blade 18 to provide cutting tension between the moving blade 20 and the stationary blade.

Figure 5:
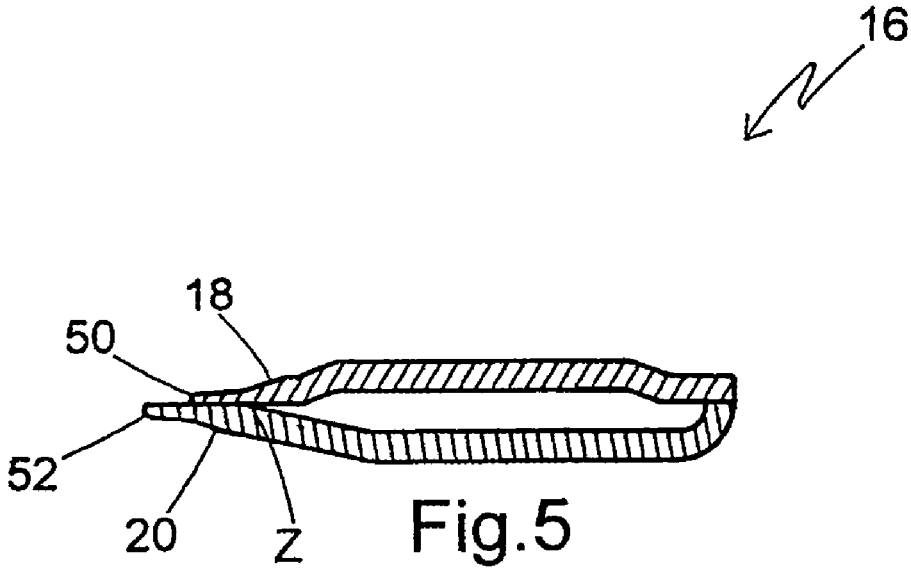
FIG. 5 is a sectional view taken at line 5-5 of FIG. 6 and in the direction indicated.
Figure 6:
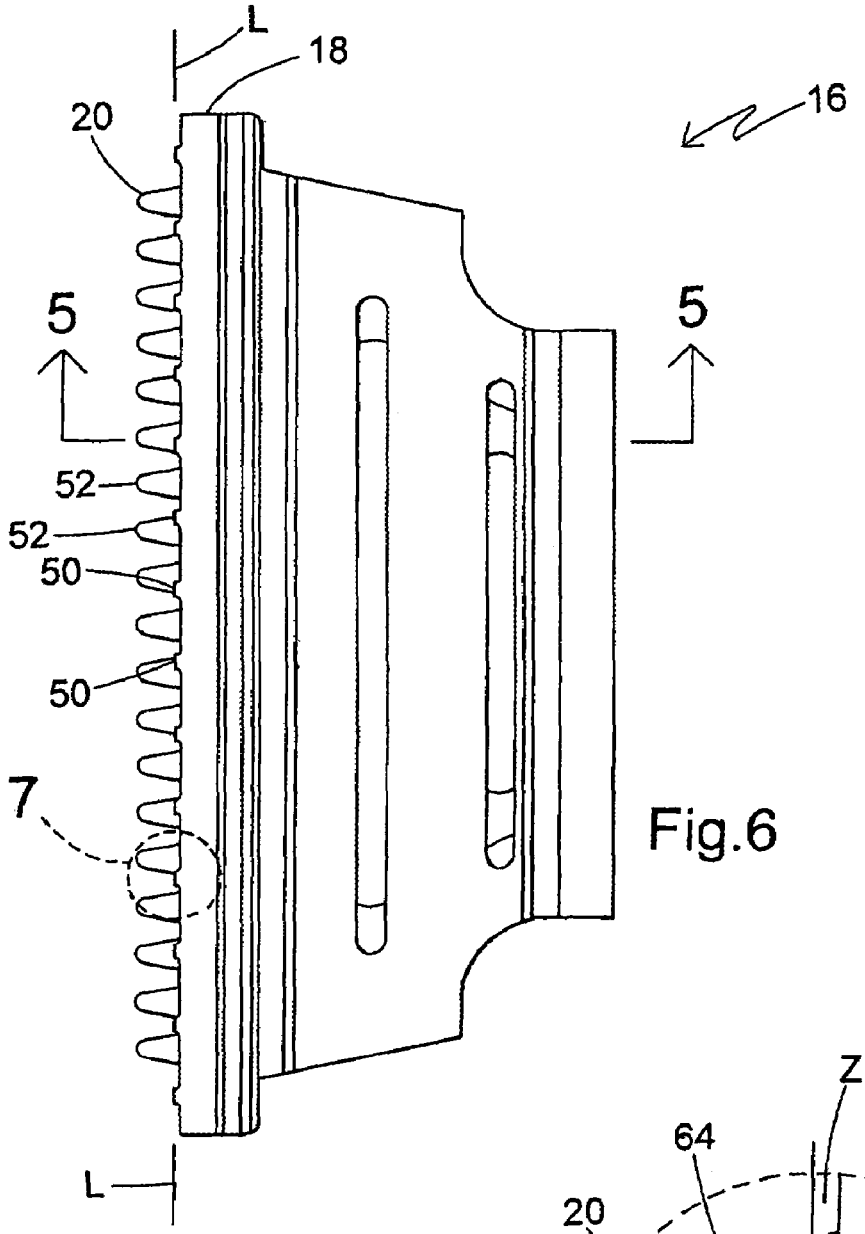
FIG. 6 is a plan view of the bladeset of FIG. 5.
Figure 7:
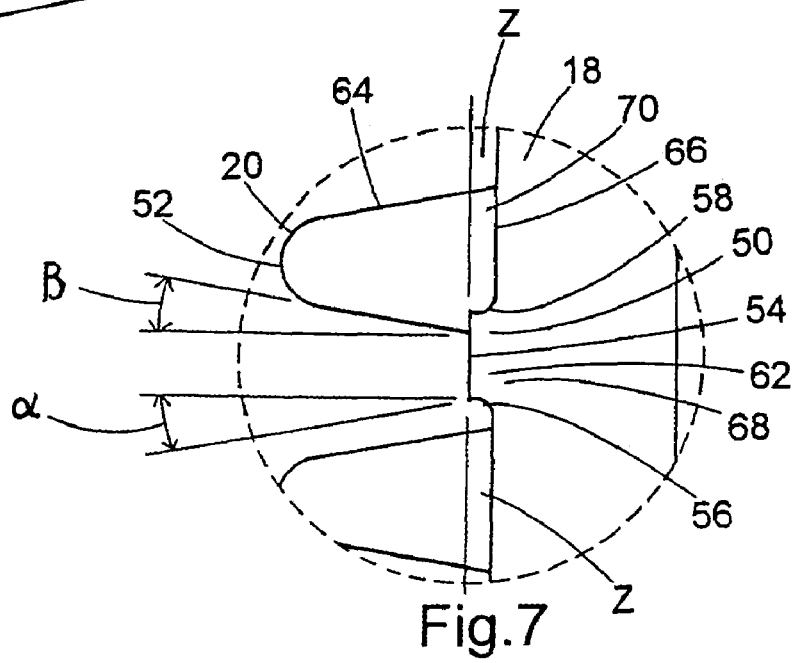
FIG. 7 is a fragmentary enlarged view of the bladeset of FIG. 6.

Turning now to FIGS. 5, 6 and 7, another feature of the present invention relates to the configuration of the bladeset 16. In the preferred embodiment, the stationary blade 18 has a plurality of stationary blade teeth 50 and the moving blade 20 has a plurality of moving blade teeth 52.

As is known in the art, the moving blade 20 is configured for laterally reciprocating relative to the stationary blade 18 to cut hair in a scissors action between its teeth 52 and the stationary blade teeth 50. In an unusual configuration designed for self-cutting, the moving blade teeth 52 are much longer than, and extend beyond the relatively shorter stationary blade teeth 50, forming a cutting zone "Z" (FIG. 7) where the moving blade teeth 52 and the stationary blade teeth 50 overlap. An important feature of the present bladeset 16 is that the blade teeth 50, 52 are configured to guide hair strands toward, and to retain hair strands in, the cutting zone "Z".

While, in the preferred embodiment, the number of stationary blade teeth 50 is less than the number of moving blade teeth 52 and the intertooth spacing reflects that relationship, it is contemplated that the relative numbers of teeth 50, 52 may vary to suit the application. Also, the stationary blade teeth 50 preferably have truncated tips 54. On either side of the stationary blade teeth 50 are undercuts 56. The undercuts 56 are shaped indentations in at least one and preferably each side edge 58 of each stationary blade tooth 50 that form an acute angle $\alpha$ with a line perpendicular to the truncated tip 54 of the stationary blade tooth 50. While, due to manufacturing limitations, the undercut 56 is preferably radiused, it is contemplated that the undercut may be provided in other shapes and still obtain the same benefits. The undercuts 56 and the side edges 58 define a waist 62 in each stationary blade tooth 50. In the preferred embodiment, the truncated tip 54 of each stationary blade tooth 50 is longer than the waist 62, which further defines the "undercut" nature of the undercut 56.

A side edge 64 of each moving blade tooth 52 forms an angle β with a line perpendicular to a bottom or base 66 of the moving blade tooth. In one embodiment of the present invention, the angles α and β are approximately equal so that the side edges 58 of the stationary blade teeth 50 are generally parallel to the closest side edges 64 of the moving blade teeth 52. Cutting is performed by bringing together from opposite sides of the hair strands blade side edges 58 and 64 that are substantially parallel to each other. It is also contemplated that the side edges 58 and the side edges 64 meet to provide a "reverse scissors action." In other words, the angle α is greater than the angle β. As such, the cutting action of the hair strands occurs closer to respective roots 68, 70 of the teeth 50, 52. This cutting action facilitates the retention and complete cutting of hair strands by the present bladeset 16.

Figure 8:
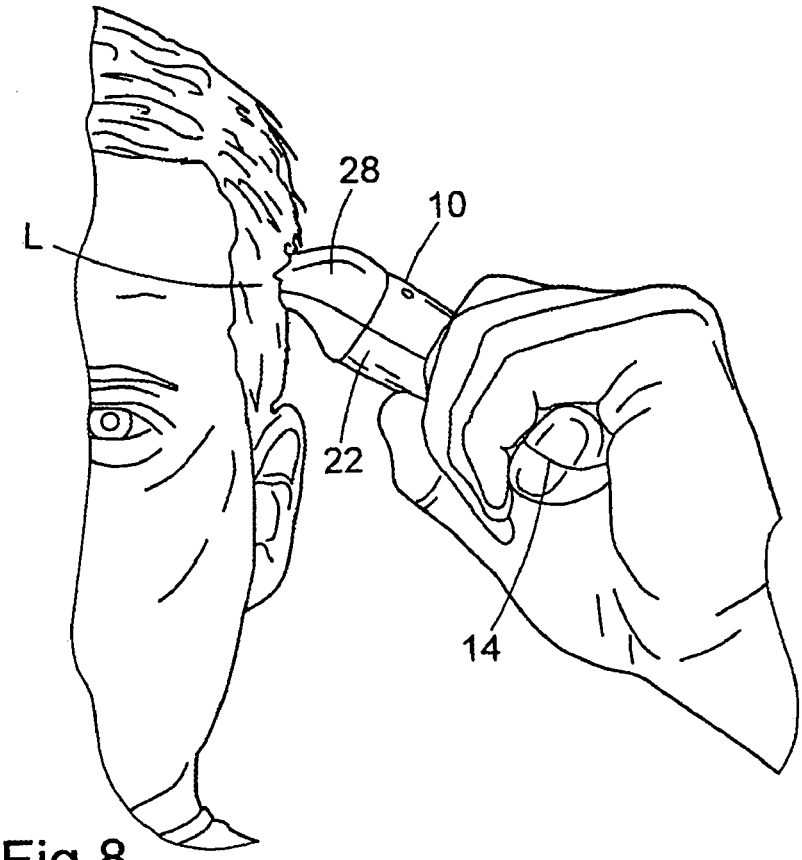
FIG. 8 is a front view of the left side of the head of a self-user of the hair trimmer of FIG. 1 with the present hair trimmer shown in the first rotated position of FIG. 4, held in a left hand of the self-user.
Figure 9:
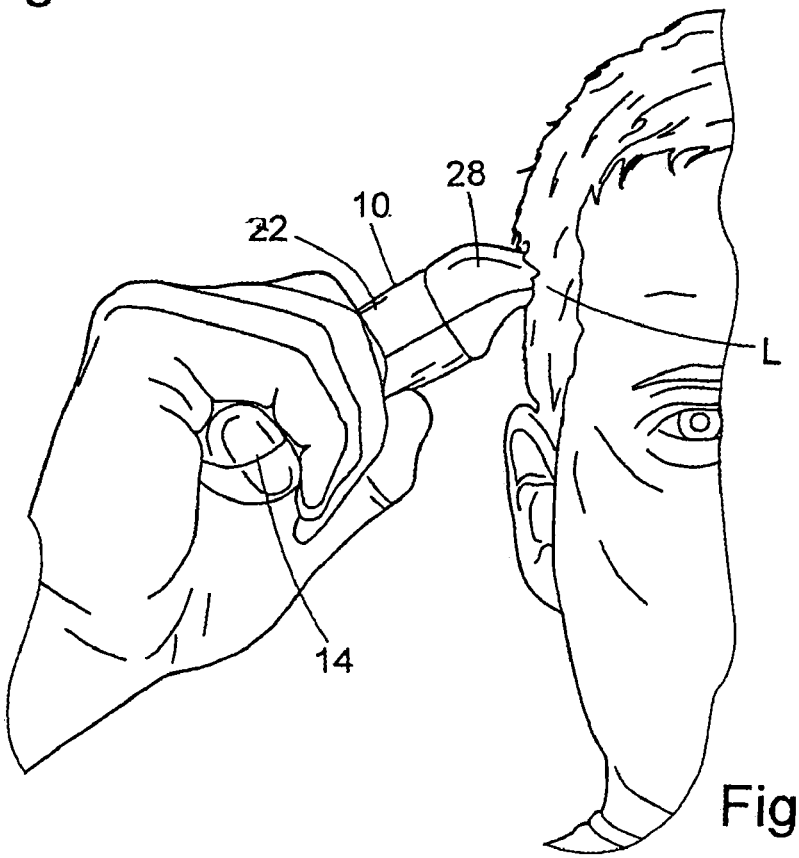
FIG. 9 is a front view of the right side of the head of a self-user of the hair trimmer of FIG. 1 with the present hair trimmer shown in the second rotated position of FIG. 4, held in a right hand of the self-user.
Figure 10:
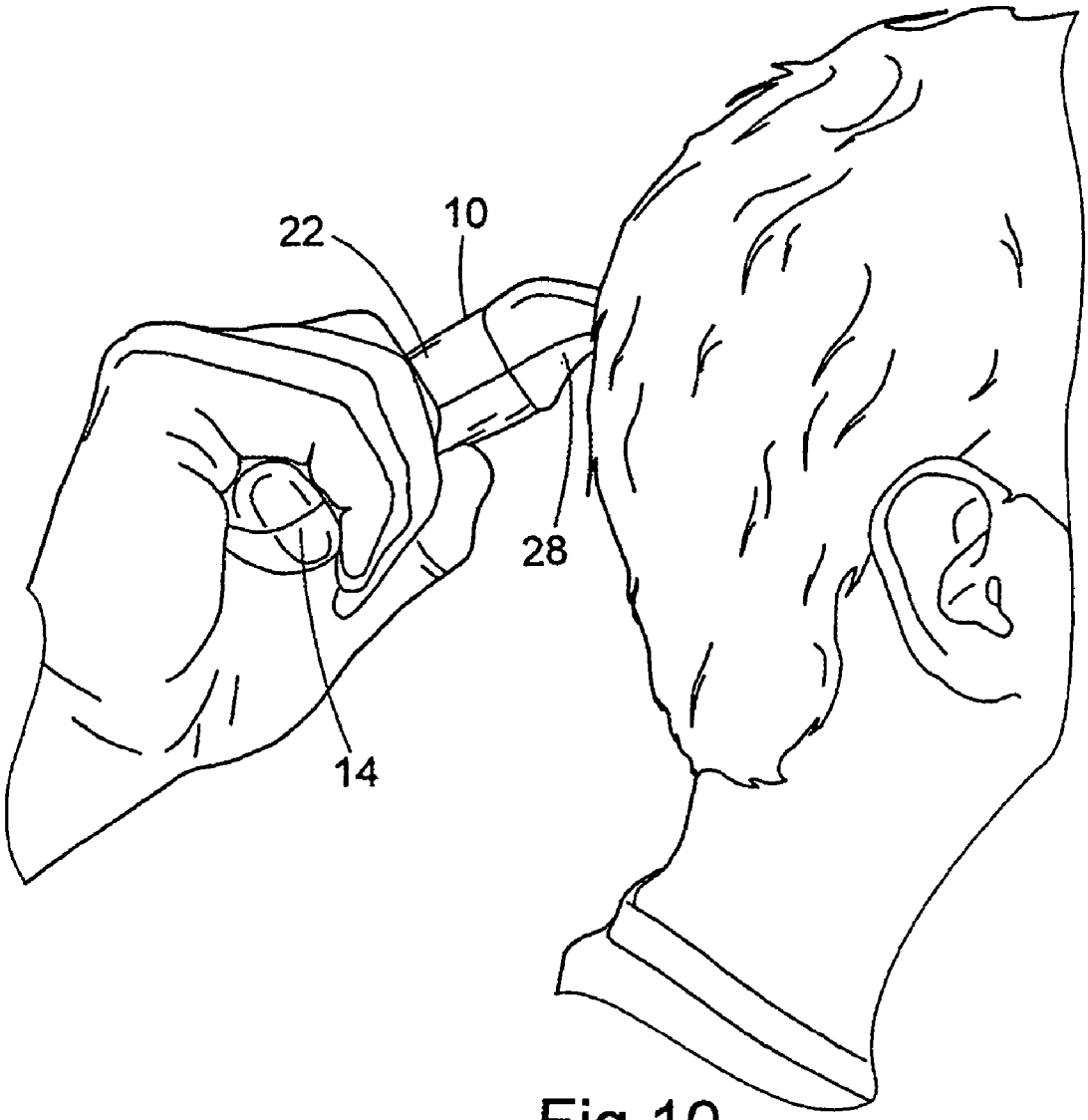
FIG. 10 is a side view of the back of the head of a self-user of the hair trimmer of FIG. 1 with the present hair trimmer shown in the first rotated position of FIG. 4, held in a right hand of the self-user.

Referring now to FIGS. 8-10, a self-user is shown holding and using the present hair clipper 10 in various grips and positions. In FIG. 8, a self-user is shown holding the hair clipper 10 in a left hand and using it to clip hair on the left side of the head. In FIG. 9, a self-user is shown holding the hair clipper 10 in a right hand and using it to clip hair on the right side of the head. In FIG. 8, the blade assembly 28 carrying the bladeset 16 is rotated to one of the two positions discussed above, and in FIG. 9, the blade assembly 28 carrying the bladeset 16 is rotated to the other of the two positions discussed above. Also as discussed above, the blade assembly 28 is retained in the selected rotational position by the interaction of the lock extension 38 and the selected detent 40. FIG. 10 shows the self-user clipping hair on the back of the head by gripping the hair clipper 10 in the right hand, with the blade assembly 28 rotated to the same position as in FIG. 9.

FIGS. 8-10 illustrate in part a preferred method embodiment of the invention. In this embodiment, a bladeset 16 is positioned at a particular angle relative to the hair strands to be trimmed. Further, the hair strands are guided toward a cutting zone "Z" of the bladeset 16 and retained in the cutting zone "Z." As shown in FIGS. 8-10, the mounting of the bladeset 16 on the rotatable blade assembly 28 that is transversely displaced from the handle 14 by the displacement component 22 permits the positioning of the cutting line "L" of the bladeset 16 to be oriented generally parallel to the axis of handle 14. This, in turn permits a self-user to hold the hair clipper 10 to position the bladeset 16 at a particular angle of attack to the hair to be trimmed by merely twisting or pronating and supinating the wrist and forearm, as opposed to bending the wrist sideways at an awkward angle, known as ulnar deviation. When this particular angle of attack of the trimmer or bladeset 16 relative to the head is substantially a right angle to the hair to be trimmed, a cross-section of the hair presented to the bladeset 16 to be trimmed is substantially minimized, reducing the problems of nicking and partial cutting described above. The guiding and retaining of the hair is performed by the bladeset 16, the moving blade teeth 52 and the stationary blade teeth 50 of which are configured to guide and retain the hair to be cut.

A self-user may apply this particular angle of attack of the trimmer or bladeset 16 relative to the head, substantially a right angle to the hair to be trimmed while holding the trimmer 10 in either hand by means of rotating the blade assembly 28 to one of the two preferred positions, 180° apart as discussed above. One of these positions of the blade assembly 28 is suitable for use in the right hand, and the other position is suitable for use in the left hand. A self-user may use the trimmer 10 to trim hair on one side of the head with the blade assembly 28 rotated to one position, then rotate the blade assembly 28 to the other position, grasp the trimmer 10 with the other hand, then trim hair on the other side of the head. In either hand, the bladeset 16 is positionable at the angle of attack. Hair on the back of the self-user's head may be trimmed with the trimmer 10 held in either hand, with the blade assembly 28 rotated to the appropriate position for the hand chosen. The trimmer 10 is even configured such that, if necessary, it may be held in a single hand and, with the blade assembly rotated to one or the other of the preferred positions, hair on either side or on the back of the head may be trimmed with the angle of attack of the trimmer 10 or bladeset 16 relative to the head substantially a right angle to the hair to be trimmed. Regardless of the rotated position of the bladeset 16, the configuration of the teeth 50, 52 is such that the trimmer 10 may be repeatedly passed through the hair in a brushing action without creating sharply defined "swaths" in the hair.

Referring now to FIGS. 11 and 12, an alternative embodiment of the trimmer 10 is generally designated 72. Components shared by the trimmers 10 and 72 have been designated with the same reference numbers. A main difference between the trimmers 10 and 72 is that the trimmer 72 is designed for use by one individual to cut the hair of another.

The configuration of the trimmer 72 generally and of the handle 74 of the trimmer 72 in particular, is such that the handle is shaped to be grasped by either hand of a user, the bladeset is displaced from the axis of handle 74 by a displacement component 76, and the cutting line "L" is generally perpendicular to the axis of handle 74. This configuration permits a person cutting another person's hair to hold the trimmer 72 in one hand or the other to position it in one of a number of potential positions to achieve the desired angle of attack of the bladeset 16 to the hair strands to be cut on any part of the other's head. The resulting movement of the user's hand is less ergonomically stressful, and only requires more natural movements, such as pronating and supinating the wrist and forearm. With this configuration, the disadvantages of ulnar deviation of prior art trimmers are avoided.

The present invention, when provided as a self-cutting hair trimmer, is holdable by a self-user such that the bladeset angle of attack is substantially perpendicular to the hair to be cut on all areas of the head, an improvement over conventional hair trimmers. Reduction of the amount of nicking and/or partial cutting of hair caused by conventional self-cutting hair trimmers is provided by the present invention, as well as more effective guiding hairs into, and retaining hairs in, a cutting zone of the bladeset. When configured as either a self-cutting trimmer or a trimmer to be used on others, the present invention facilitates hair trimming in an ergonomically comfortable manner.

While a particular embodiment of the self-cutting hair trimmer has been described herein, it will be appreciated by those skilled in the art that changes and modifications may be made thereto without departing from the invention in its broader aspects and as set forth in the following claims.

We claim:

1. A method for self-cutting hair, comprising:

providing an electrically powered hair trimmer with an elongate handle and a rotatable bladeset defining a cutting line generally parallel to a longitudinal axis of the handle, said bladeset including a stationary blade and a moving blade configured for laterally reciprocating relative to said stationary blade;

rotating said bladeset in a plane generally parallel to said longitudinal axis of said handle to a designated cutting position so that the cutting line is directable toward a designated side of the user's head;

gripping said handle with the hand adjacent the designated side of the head; and stroking the trimmer through the user's hair on the designated side of the head at an angle of attack so that the hair is engaged by said moving blade wherein said handle is L-shaped, and said bladeset is mounted on the end of a short leg of said L-shaped handle, said longitudinal axis being on a long leg of said L-shaped handle, and said handle containing a motor for powering said moving blade.

2. The method recited in claim 1, further comprising positioning said bladeset at said angle of attack relative to hair strands to be trimmed; and cutting said hair strands by bringing together from opposite sides of the hair strands blade edges that are substantially parallel to each other.

3. The method recited in claim 2 wherein said particular angle of attack is substantially perpendicular to the hair strands to be trimmed.

4. The method of claim 2 further comprising one of guiding the hair strands toward a cutting zone of said bladeset and retaining the hair strands in said cutting zones.

5. The method recited in claim 1, further comprising cutting the hair strands with a reverse scissors action.

6. The method of claim 1 further including:

upon completion of use of the trimmer with the hand on the designated side, rotating the bladeset in said plane generally parallel to said longitudinal axis of said handle to a second designated position corresponding to another side of the head;

gripping the handle with the other of user's hands adjacent the other side of the head; and stroking the trimmer through the hair at the same angle of attack with the other hand.

7. The method of claim 6 further including releasably locking the bladeset in each of said designated positions so that the same angle of attack is achieved regardless of which hand the user uses to move the trimmer through the hair.

8. The method of claim 6 further including gripping the trimmer in the other hand in a similar hand orientation to the first hand while achieving the same angle of attack.

9. The method of claim 6 further including rotating said bladeset 180° between the first and second designated positions.

10. The method of claim 1 wherein the cutting line is transversely offset from said longitudinal axis of said handle.

11. The method of claim 1 further including maintaining said bladeset in said designated position generally coplanar with a housing of said trimmer.

12. A method for self-cutting hair, comprising:

providing an electrically powered hair trimmer with an elongate handle and a rotatable bladeset defining a cutting line generally parallel to a longitudinal axis of the handle, said bladeset including a stationary blade and a moving blade configured for laterally reciprocating relative to said stationary blade;

rotating said bladeset in a plane generally parallel to said longitudinal axis of said handle to a designated cutting position so that the cutting line is directable toward a designated side of the user's head;

releasably locking said bladeset in said cutting position;

gripping said handle with a first hand adjacent the designated side of the head;

stroking the trimmer through the user's hair on the designated side of the head at an angle of attack so that hair is engaged by said moving blade;

upon completion of use of the trimmer with the hand on the designated side, rotating the bladeset in said plane generally parallel to said longitudinal axis of said handle to a second designated position corresponding to another side of the head;

releasably locking said bladeset in said second designated cutting position;

gripping the handle with the other of user's hands corresponding to the selected side of the head; and stroking the trimmer through the hair at the same angle of attack with the other hand wherein said handle is L-shaped, and said bladeset is mounted on the end of a short leg of said L-shaped handle, said longitudinal axis being on a long leg of said L-shaped handle, and said handle containing a motor for powering said moving blade.

13. The method of claim 12 further including gripping the trimmer in the other hand in a similar hand orientation to the first hand while achieving the same angle of attack.

* * * * *